United States Patent [19]

Carin

[11] 4,257,391

[45] Mar. 24, 1981

[54] STEPPED CONCENTRIC FIRE GRATE

[76] Inventor: Jesus R. Carin, Bulacan, Bulacan, Philippines

[21] Appl. No.: 40,219

[22] Filed: May 18, 1979

[51] Int. Cl.[3] ..... F23H 1/02

[52] U.S. Cl. ..... 126/163 R; 126/25 B

[58] Field of Search ..... 126/152 A, 152 B, 152 R, 126/163 A, 164, 165, 182, 181, 25 B, 163 R, 65; 110/294

[56] References Cited

U.S. PATENT DOCUMENTS

| | | | |
|---|---|---|---|
| Re. 121 | 7/1848 | Morse et al. | 126/163 A |
| 753,298 | 3/1904 | Nehse | 126/163 A |
| 1,078,071 | 11/1913 | Tait | 126/182 |
| 1,541,649 | 6/1925 | Martin | 126/182 |
| 2,380,630 | 7/1945 | Cross | 126/152 R |

FOREIGN PATENT DOCUMENTS

| | | | |
|---|---|---|---|
| 1363007 | 11/1922 | Fed. Rep. of Germany | 126/163 R |
| 506822 | 4/1920 | France | 126/152 R |
| 733406 | 10/1932 | France | 126/152 R |

*Primary Examiner*—James C. Yeung

*Attorney, Agent, or Firm*—Haseltine and Lake

[57] ABSTRACT

A fire grate for holding particulate carbonaceous fuel such as sawdust and powdered coal consisting of stepped horizontally disposed and vertically spaced concentric grate members having center openings and defining a pyramidal structure. The grate is enclosed by the fuel which, by virtue of the stepped arrangement of the concentric grate members, is prevented from freely falling through the spaces between adjacent grate members.

1 Claim, 3 Drawing Figures

STEPPED CONCENTRIC FIRE GRATE

This invention relates particularly to a fire grate for holding particulate carbonaceous fuel.

Fire grates are designed in accordance with the criterion that they should be able to hold the fuel and at the same time permit the passage of atmospheric air therethrough. The character of the fuel has much to do with the form of the grate, particularly with regards to the openings thereof. Heretofore, fire grates for holding particulate carbonaceous fuel are in the form of perforated flat slabs of cast iron which belong to the type of fire grate commonly referred to as "lineal flat grate".

The perforated cast iron slab barely satisfies the design criterion of a good fire grate, especially when it is used for sawdust or powdered coal. The perforations do not permit sufficient contact area between atmospheric air and the fuel, resulting in poor burning efficiency. One way of offsetting the problem is to convert these types of fuel into briquettes, an expensive procedure which requires the use of machines.

The present invention proposes a solution to the aforesaid deficiency of the prior art by providing a fire grate formed of stepped, horizontally disposed and vertically spaced concentric metal grate members having center openings. Due to the ladder-like structure of the grate, the sawdust or like particulate fuel which encloses the grate is prevented from falling through the spaces between adjacent concentric grate members. Thus, the distance between adjacent members could be maximized to provide relatively greater contact area between the fuel and atmospheric air, resulting in very efficient combustion.

Another object of the invenetion is to provide a fire grate capable of inducing a natural air draft to promote combustion. The grate itself defines an abbreviated chimney, a feature which also makes it applicable to stoves and like fireplaces.

A further object of the invention is to provide a fire grate construction which is very simple, economical to mnufacture and efficient in operation.

Further objects, features and advantages of the invention will become apparent from a consideration of the following description of the appended illustrative drawings in which.

Referring now to the drawings, similar numerals of reference indicate corresponding parts throughout.

Figure 1:
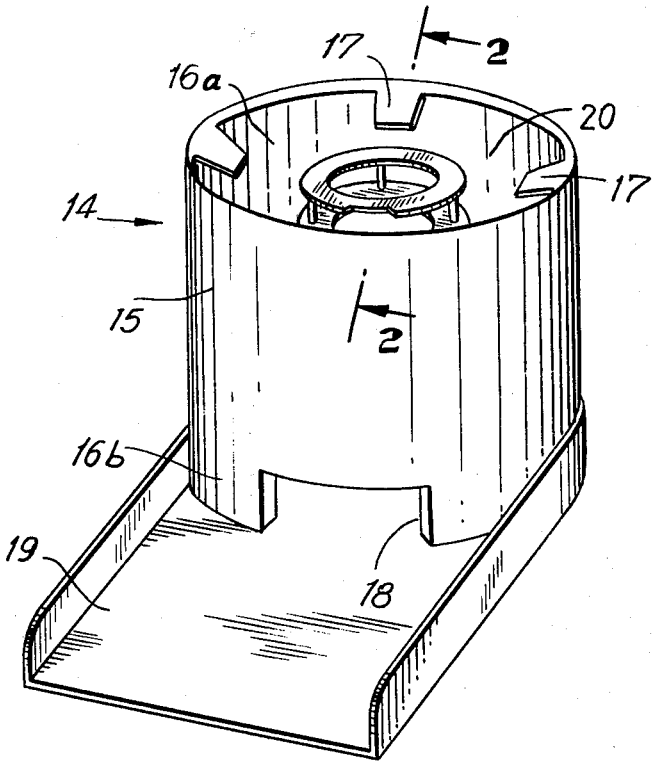
FIG. 1 is a perspective view of a stove to which the fire grate of the invention is applied.
Figure 2:
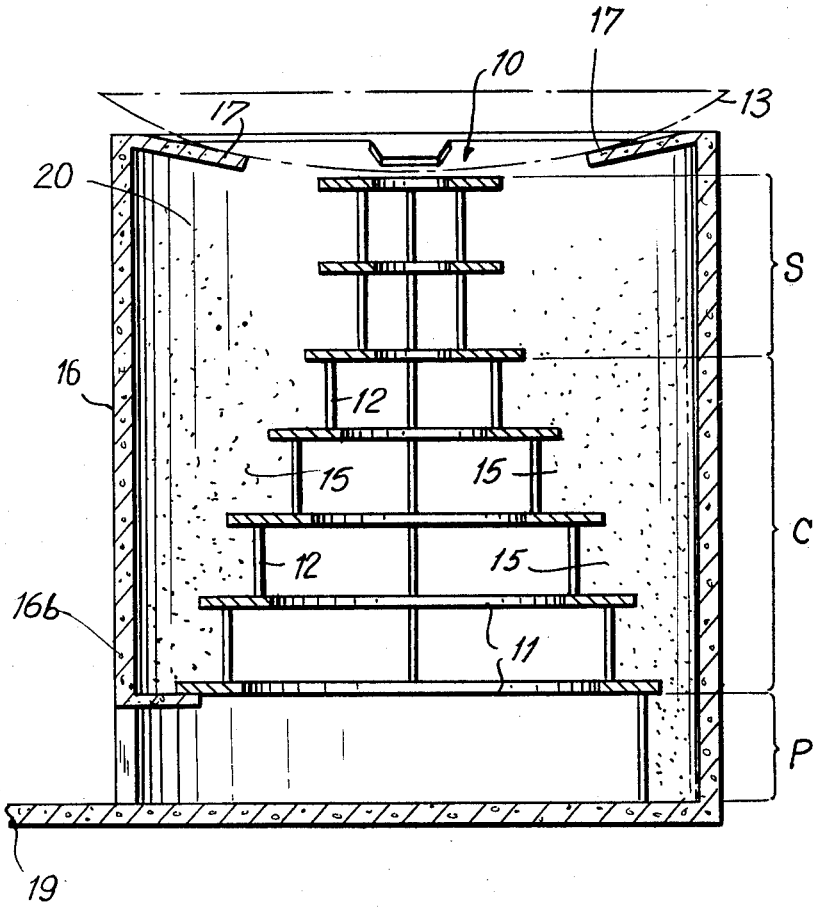
FIG. 2 is a sectional view taken along line 2–2 of FIG. 1.
Figure 3:
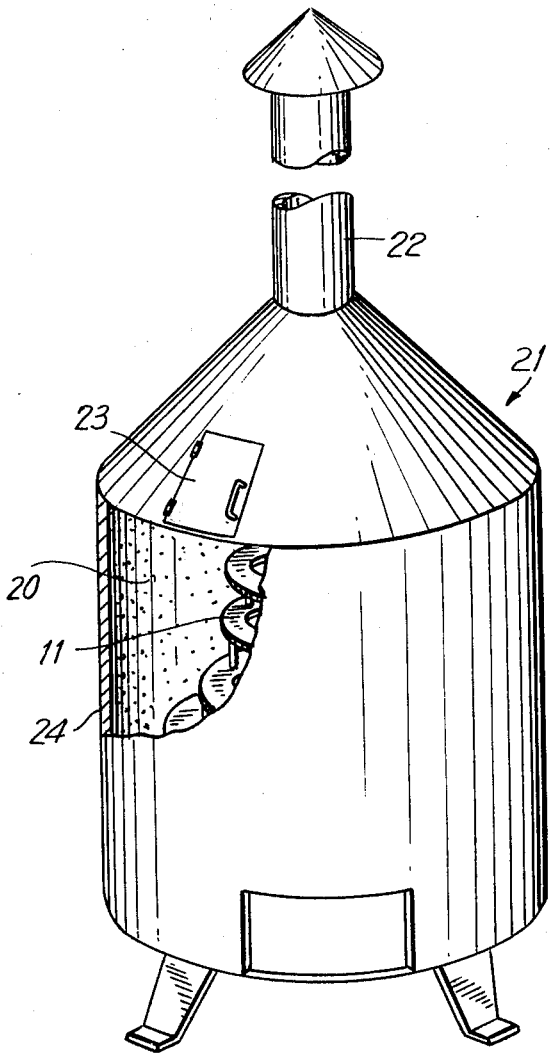
FIG. 3 is a perspective view of another device utilizing the invention.

The fire grate 10 comprises a plurality of horizontally disposed and vetically spaced concentric flat, grate members having center openings, such as rings 11. The concentric grate members downwardly increase in size to define a stepped pyramidal structure. The rings are fixedly spaced by upright studs 12 welded at their upper ends to the underside of the upper ring and at their lower ends to the upper side of the adjacent lower ring. Preferably, the upper three rings are equally dimensioned to provide a stack zone S. The stack zone provides additional draft head and at the same time guides the combusion gases to the central upper portion of the grate and directly to the bottom of the cooking pot 13, if the grate is applied to a stove 14.

Immediately below the stack zone is the combustion zone C, where the exposed fuel areas 15 are actively burned. The lower portion P of the grate defines the preheating zone, where the freshly introduced fuel is heated to kindling temperature. The heat energy in this zone is supplies mainly by the combustion zone. The total draft head equals the vertical height of the stack zone and combustion zone.

When applied to a stove 14, the fire grate is disposed centrally of a shell 16 formed of any suitable refractory material. The upper open end 16*a* of the shell may be provided with pot holders 17 and the lower end 16*b* thereof with a stove door 18. The stove shell may rest on a feed tray 19.

To operate the stove, particulate fuel 20 is fed at the upper open end thereof, totally enclosing the fire grate 10. Since the grate members are stepped, the exposed fuel areas 15 slope inwardly, substantially preventing the fuel from falling freely between adjacent rings. Compared to the known perforated lineal type grate, the fuel area exposed to air and heat is relatively much greater, rendering combustion thereof easier and more efficient.

Initial kindling of the fuel is done by placing combustible material in the preheating zone through the stove door and igniting it.

Initial kindling of the fuel is done by igniting combustible material placed in the preheating zone through the stove door.

The fire grate construction of the present invention may be applied to heaters 21, wherein the hot gas may be tapped from stack 22 thereof, and fuel is fed though the swing door 23 provided at the upper end of the closed shell 24 enclosing the grate 10.

The fire grate is also applicable to all types of fireplaces, such as a boiler dutch oven. In lieu of the flat rings, the concentric grate members may be rectangular, hexagonal or triangular in plan view.

The invention is obviously not limited to the forms of embodiment which have been disclosed and it must be accordingly understood that it is not limitative to other possibilities which lie within the scope of the appended claims.

What I claim is:

1. A fire grate comprising:

a plurality of annular horizontally arranged grate members, the width of the annulus of each grate member being substantially the same as the width of the annulus of each other of the grate members;

spacers supporting the respective grate members in a coaxial stack in vertically spaced relationship;

respective grate members at the lower end of the stack of progressively decreasing diameter in a direction upwardly of the stack to define a truncated conical structure providing a draft head of progressively decreasing diameter in an upward direction;

grate members at the upper end of the stack of substantially the same diameter as each other to define a cylindrical structure summounting said truncated conical structure, said cylindrical structure providing an upward extension of the draft head of substantially constant diameter;

the respective grate members each being of an external diameter substantially greater than the internal diameter of the next adjacent grate member in said stack.

* * * * *